US012402713B1

(12) United States Patent
Burnsed, Jr. et al.

(10) Patent No.: US 12,402,713 B1
(45) Date of Patent: Sep. 2, 2025

(54) LOAD CARRIER ATTACHMENT FACILITY

(71) Applicant: Blue Force Gear, Inc., Pooler, GA (US)

(72) Inventors: Ashley A. Burnsed, Jr., Savannah, GA (US); Stephen G. Hilliard, Charleston, SC (US)

(73) Assignee: Blue Force Gear, Inc., Pooler, GA (US)

( * ) Notice: Subject to any disclaimer, the term of this patent is extended or adjusted under 35 U.S.C. 154(b) by 340 days.

(21) Appl. No.: 17/902,339

(22) Filed: Sep. 2, 2022

Related U.S. Application Data

(60) Provisional application No. 63/244,397, filed on Sep. 15, 2021.

(51) Int. Cl.
*A45F 5/02* (2006.01)
*A45F 3/06* (2006.01)
*A45F 3/10* (2006.01)

(52) U.S. Cl.
CPC ..... *A45F 3/10* (2013.01); *A45F 3/06* (2013.01); *A45F 5/02* (2013.01); *A41D 2400/48* (2013.01)

(58) Field of Classification Search
CPC ..... A45F 5/02; A45F 3/10
See application file for complete search history.

(56) References Cited

U.S. PATENT DOCUMENTS 5,881,933 A * 3/1999 Rogers ..... F41C 33/041 224/195
D409,114 S * 5/1999 Bortner ..... D11/216
6,098,859 A * 8/2000 Bortner ..... A45F 3/047 224/195
7,507,141 B2 * 3/2009 Ward ..... A41F 15/002 450/86
8,220,677 B2 * 7/2012 Liang ..... A45F 5/02 224/271
8,539,646 B2 * 9/2013 Falvai ..... A44B 11/258 24/200
8,584,917 B2 * 11/2013 Hexels ..... A45F 3/14 2/2.5
8,814,020 B2 * 8/2014 Yaeger ..... A45F 3/06 224/665
10,238,160 B1 * 3/2019 Mabon ..... A41F 15/002
10,918,169 B2 * 2/2021 Kolasa ..... A44B 99/00
10,959,496 B2 * 3/2021 Moeller ..... A44B 19/303
12,059,080 B2 * 8/2024 Fan ..... A47D 13/025
(Continued)

*Primary Examiner* — Justin M Larson

(74) *Attorney, Agent, or Firm* — Eversheds Sutherland (US) LLP

(57) ABSTRACT

A load carrier attachment facility has a support structure, an attachment removably connected to the support structure, an elongated piping element connected to one of the support structure and the attachment, an elongated channel element connected to the other of the support structure and the attachment, the elongated piping element having a head with a first width and a neck having a second width less than the first width, the elongated channel element defining a passage configured to receive the head, having an elongated gap smaller than the width of the head, and the elongated gap being configured to receive the neck. The one of the support structure and the attachment to which the elongated piping element is connected may be a flexible sheet, and the neck of the elongated piping element may be connected to the flexible sheet along the length of the neck.

16 Claims, 5 Drawing Sheets

(56) References Cited

U.S. PATENT DOCUMENTS

| | | | | |
|---|---|---|---|---|
| 12,102,215 | B2 * | 10/2024 | Li | A45F 3/12 |
| 2009/0282595 | A1 * | 11/2009 | Branson | F41H 1/02 2/2.5 |
| 2024/0268544 | A1 * | 8/2024 | Ahl | A45F 5/02 |

* cited by examiner

LOAD CARRIER ATTACHMENT FACILITY

CROSS-REFERENCE TO RELATED APPLICATION

This application claims the benefit of U.S. Provisional Patent Application No. 63/244,397 filed on Sep. 15, 2021, entitled "RAIL SYSTEM FOR ATTACHING ACCESSORIES TO TACTICAL EQUIPMENT," which is hereby incorporated by reference in its entirety for all that is taught and disclosed therein.

FIELD OF THE INVENTION

The present invention relates to load carriers, and more particularly to a load carrier attachment facility that enables ease of attachment of accessories to a load carrier in a variety of locations.

BACKGROUND OF THE INVENTION

Load carriers are used for a variety of equipment and objects and are employed by a variety of professionals or technicians to facilitate their work. For example, military and law enforcement personnel require the carrying of objects, many of which have a significant weight, such as firearms, ammunition, and communication devices. Additionally, safety items and emergency-type objects are oftentimes carried by such personnel, who are frequently required to work in remote or dangerous locations. Under life-threatening circumstances, the more conveniently survival and defense items can be stored, transported, and accessed, the better.

Conventional load carriers utilize a series of pouches, pockets and connectors, such as straps, snaps, buckles, buttons, or hook and loop fasteners. These storage features can be attached to a garment that allows the wearer to more easily store and carry certain items while leaving the hands of the user free for other work. As used herein, the term "garment" refers to any outer covering placed on and carried by a person.

Drawbacks to conventional load carriers and storage features include the bulk and weight of the overall garment. During extreme temperatures or arduous travel, a heavy and large load carrier can contribute to the stress and fatigue of the user. Another potential problem includes the impractical design of the garment, which may have oddly placed pockets or attachment features, requiring additional effort by the user to locate and retrieve stored items. Some storage features may prove difficult to combine with garments in a releasable manner, and thus must be permanently affixed, which limits the flexibility and usefulness of the garment and storage features. Still other load carriers and storage features are constructed from materials that create difficulties in the insertion and removal of items needing ready access.

Therefore, a need exists for a new and improved load carrier attachment facility that enables ease of attachment of accessories to a load carrier in a variety of locations. In this regard, the various embodiments of the present invention substantially fulfill at least some of these needs. In this respect, the load carrier attachment facility according to the present invention substantially departs from the conventional concepts and designs of the prior art, and in doing so provides an apparatus primarily developed for the purpose of enabling ease of attachment of accessories to a load carrier in a variety of locations.

SUMMARY OF THE INVENTION

The present invention provides an improved load carrier attachment facility, and overcomes the above-mentioned disadvantages and drawbacks of the prior art. As such, the general purpose of the present invention, which will be described subsequently in greater detail, is to provide an improved load carrier attachment facility that has all the advantages of the prior art mentioned above.

To attain this, the preferred embodiment of the present invention essentially comprises a support structure, an attachment removably connected to the support structure, an elongated piping element connected to one of the support structure and the attachment, an elongated channel element connected to the other of the support structure and the attachment, the elongated piping element having a head with a first width and a neck having a second width less than the first width, the elongated channel element defining a passage configured to receive the head, having an elongated gap smaller than the width of the head, and the elongated gap being configured to receive the neck. The one of the support structure and the attachment to which the elongated piping element is connected may be a flexible sheet, and the neck of the elongated piping element may be connected to the flexible sheet along the length of the neck. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
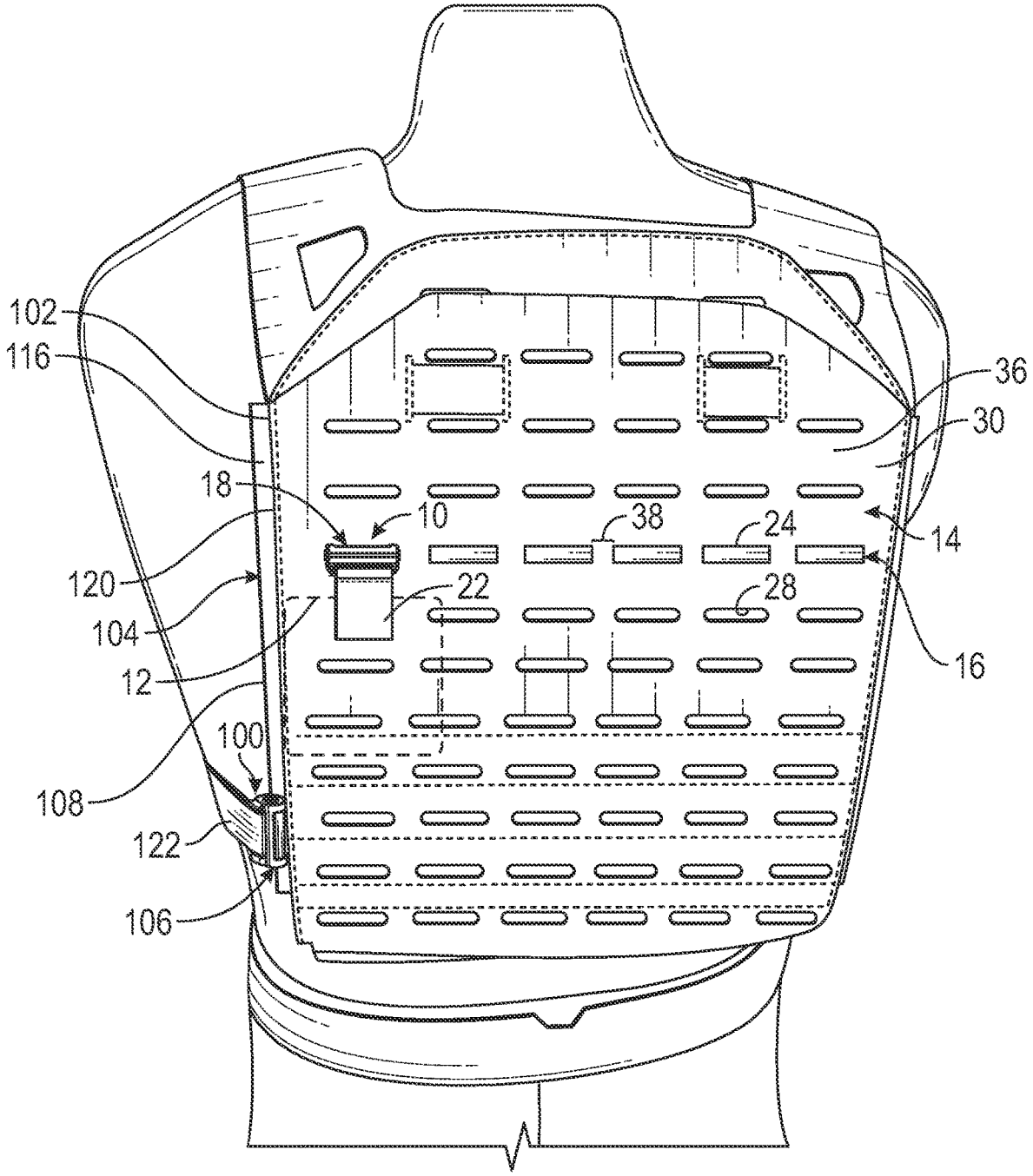
FIG. 1 is a top perspective view of the current embodiment of a load carrier attachment facility constructed in accordance with the principles of the present invention in removably connecting an attachment in the form of a pouch to a support structure/garment and an alternative embodiment of a load carrier attachment facility constructed in accordance with the principles of the present invention removably connecting a securing strap to the support structure/garment.
Figure 2:
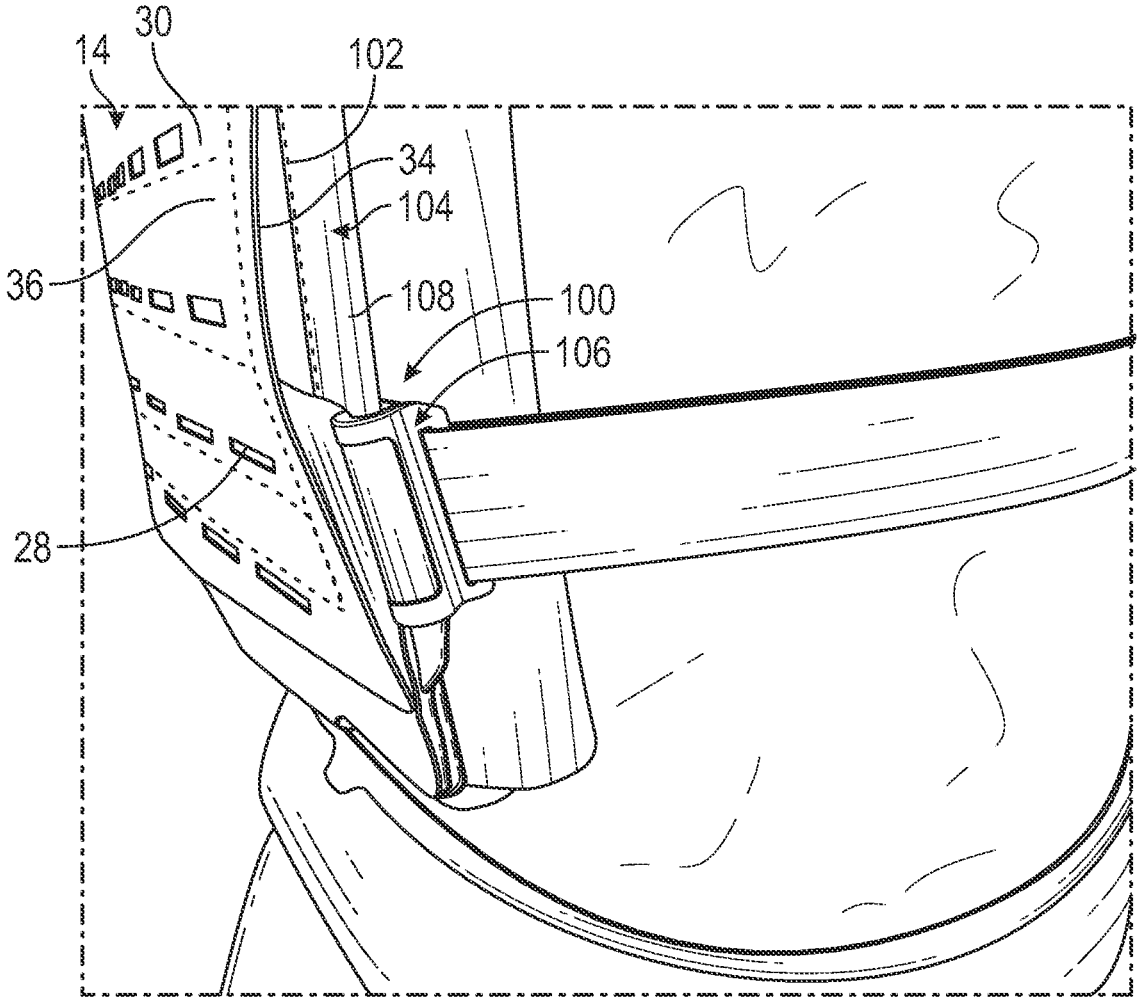
FIG. 2 is an enlarged side partial view of the alternative embodiment of the load carrier attachment facility of FIG. 1 in use removably connecting a securing strap to a support structure/garment.
Figure 3B:
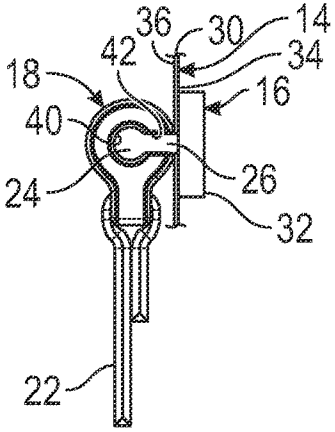
FIG. 3B is an enlarged end view of the load carrier attachment facility of FIG. 3A in use removably connecting an attachment to a support structure/garment.
Figure 3A:
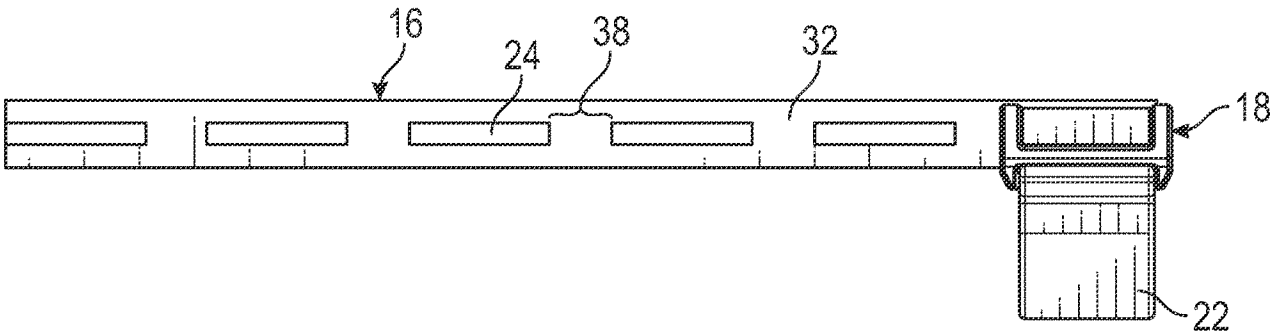
FIG. 3A is an enlarged top view of the load carrier attachment facility of FIG. 1 in use removably connecting an attachment to a support structure/garment.
Figure 4:
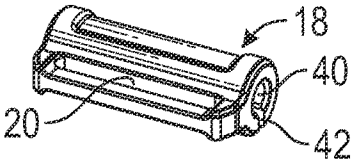
FIG. 4 is a plurality of views of the elongated channel element of FIG. 1.
Figure 4:
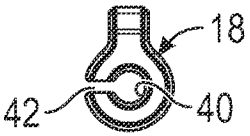
Figure 4:
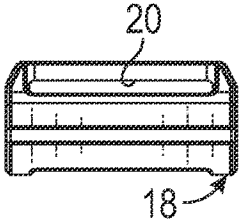
Figure 4:
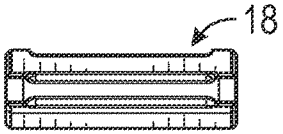
Figure 4:
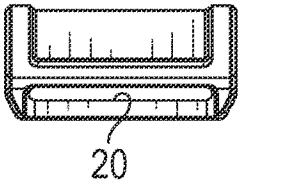
Figure 5:
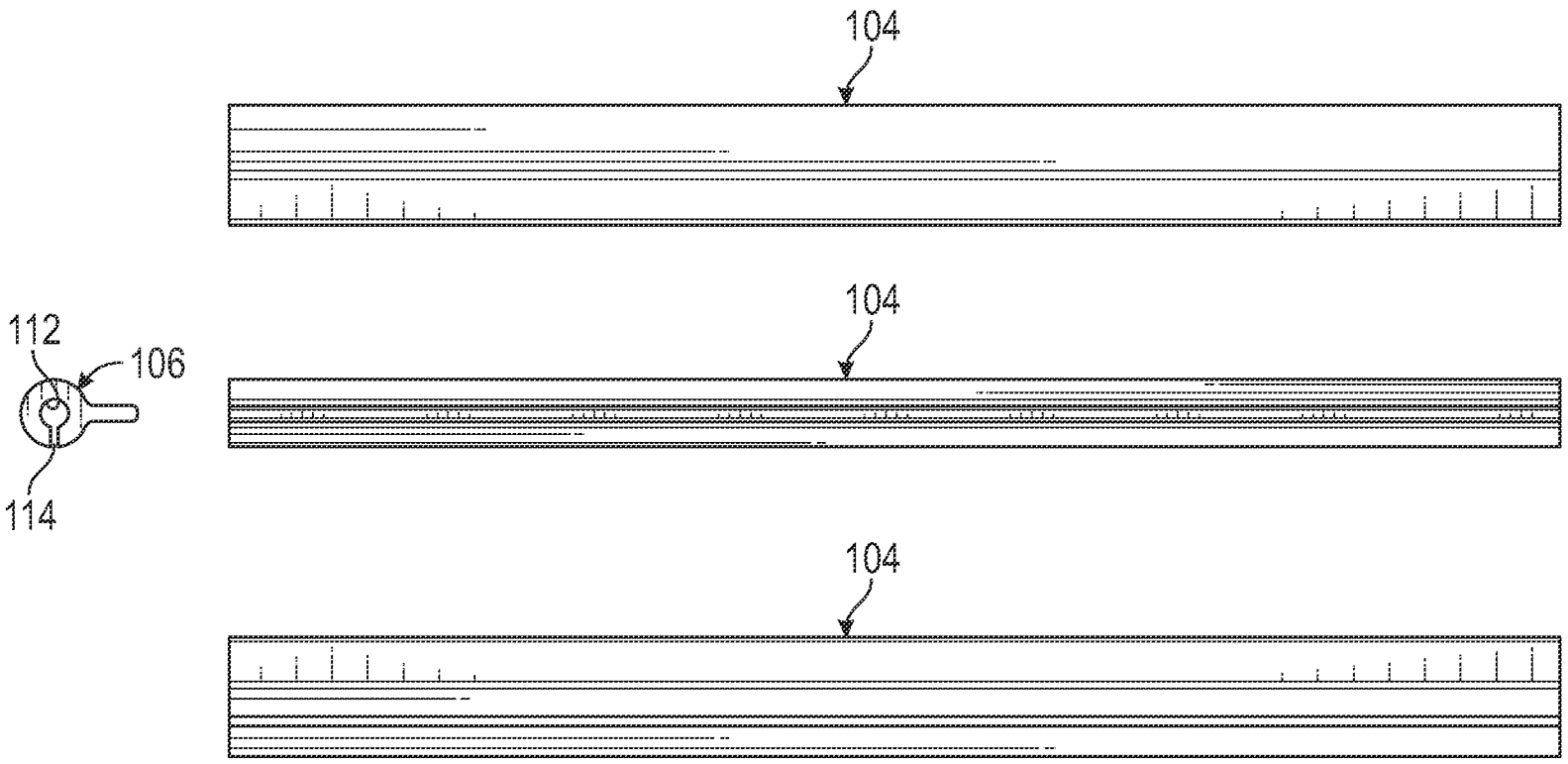
FIG. 5 is a plurality of views of the alternative embodiment of the load carrier attachment facility of FIG. 1.
Figure 6A:
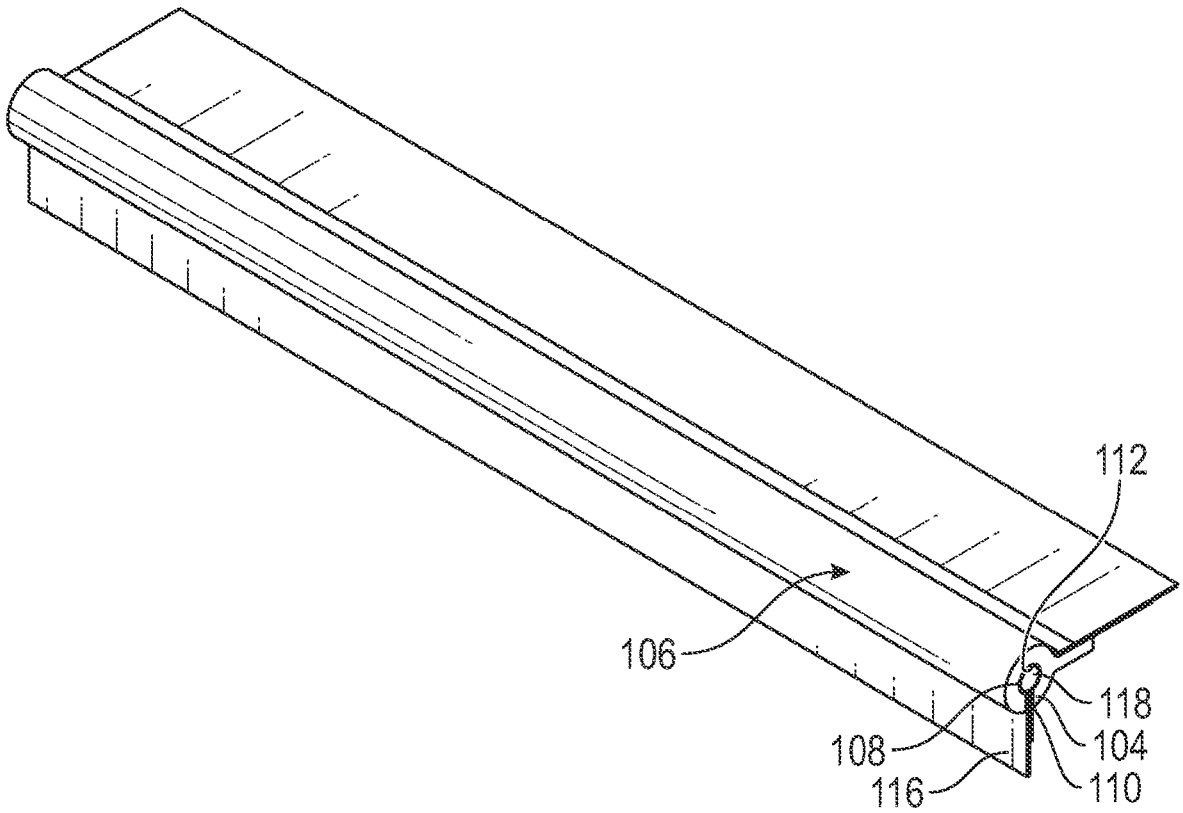
FIG. 6A is an isometric view of the alternative embodiment of the load carrier attachment facility of FIG. 5 in use showing the elongated channel element removably connected to the elongated piping element.
Figure 6B:
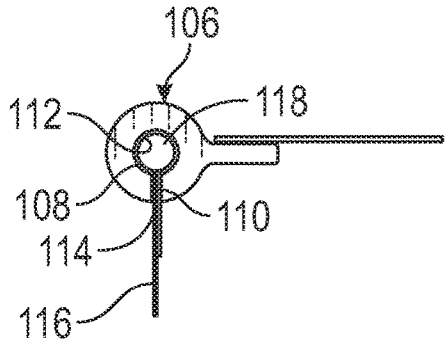
FIG. 6B is an end view of the alternative embodiment of the load carrier attachment facility of FIG. 5.

An embodiment of the load carrier attachment facility of the present invention is shown and generally designated by the reference numeral 10.

FIGS. 1-4 illustrate the improved load carrier attachment facility 10 of the present invention. More particularly, FIG. 1 shows the load carrier attachment facility 10 in use removably connecting an attachment 12 in the form of a pouch storage accessory in the current embodiment to a support structure 14 in the form of a garment such as a vest worn by a user in the current embodiment. An elongated piping element 16 is connected to one of the support structure and the attachment. An elongated channel element 18 is connected to the other of the support structure and the attachment. The elongated channel element is a connector having an attachment facility 20 in the form of a slot configured to connect to an additional element 22 in the form of a strap in the current embodiment.

In the current embodiment, the elongated piping element 16 has a plurality of spaced apart head and neck sections 24, 26, each head and neck section configured to protrude through an aperture 28 of a webless Modular Lightweight Load-carrying Equipment (MOLLE) flexible sheet 30 for connection to the elongated channel element 18. A planar backer 32 interconnects the head and neck sections. The planar backer is configured to reside on one side 34 of the webless MOLLE sheet, and the head sections protrude to connect to the elongated channel element on the opposed side 36 of the webless MOLLE sheet. The one of the support structure 14 and the attachment 12 to which the elongated piping element is connected is a webless Modular Lightweight Load-carrying Equipment (MOLLE) flexible sheet, and the neck section of the elongated piping element is connected to the webless Modular Lightweight Load-carrying Equipment (MOLLE) flexible sheet along the length of the neck section.

The head section 24 of the elongated piping element 16 has a first width, and the neck section 26 has a second width less than the first width. In the current embodiment, the second width is 0.10 inch. Each head and neck section has a length of 1.04 inch and is separated from adjacent head and neck sections by a gap 38 of 0.46 inch. The elongated channel element defines a passage 40 with a radius of 0.08 inch configured to receive the head section. The elongated channel element has an elongated gap 42 of 0.07 inch that is smaller than the first width of the head section, and the elongated gap is configured to receive the neck section. The length of the elongated channel element is 1.25 inch in the current embodiment.

FIGS. 1, 2, 5, 6A, & 6B illustrate an alternative embodiment of the improved load carrier attachment facility 100 of the present invention. More particularly, the load carrier attachment facility 100 has a support structure 102, an attachment 122 removably connected to the support structure, an elongated piping element 104 connected to one of the support structure and the attachment, and an elongated channel element 106 connected to the other of the support structure and the attachment. The attachment is a securing belt in the current embodiment. The elongated piping element has a head 108 with a first width and a neck 110 having a second width less than the first width. The elongated channel element defines a passage 112 configured to receive the head. The passage has an elongated gap 114 smaller than the width of the head, and the elongated gap is configured to receive the neck. The one of the support structure and the attachment to which the elongated piping element is connected is a flexible sheet 116, and the neck of the elongated piping element is connected to the flexible sheet along the length of the neck. The one of the support structure and the attachment to which the elongated piping element is connected includes an elongated core 118, and the support structure to which the elongated piping element is connected is a flexible sheet that wraps about the elongated core to form the head. In the current embodiment, the neck is stitched to closely receive the elongated core in an elongated pocket. the head and the neck of the elongated piping element are connected to the flexible sheet along the length of the flexible sheet. The support structure is a garment in the current embodiment. The support structure includes a flexible sheet having a periphery 120, and at least one of the elongated piping element and the elongated channel element is connected along the periphery. The flexible sheet is a webless Modular Lightweight Load-carrying Equipment (MOLLE) flexible sheet in the current embodiment.

In both embodiments, the support structure features a series of omnidirectional elongated piping elements that are sewn or otherwise attached to the support structure. Each attachment is removably connected to the support structure by an elongated channel element by sliding the elongated channel element over and onto a selected elongated piping element. Friction of the elongated channel element clamping around the selected elongated piping element holds the attachment in position. Examples of suitable garments that could serve as support structures include vests, belts, shirts, pants, jackets, harnesses, and backpacks. Examples of suitable attachments include pouches, pads, holsters, shields, carriers, and securing straps.

The elongated piping elements can be manufactured either as an injection molded part using a multipart mold tool to form the part or by using standard cut and sew methods whereby a piece of stiffened cord serving as the elongated core is captured underneath a piece of fabric forming an elongated pocket to make the elongated piping element. The elongated channel elements can be manufactured either as an injection molded part using a multipart mold tool to form the part or as an extrusion that can then be cut to length.

While current embodiments of a load carrier attachment facility have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A load carrier attachment facility comprising:

a support structure;

an attachment removably connected to the support structure;

an elongated piping element connected to one of the support structure and the attachment; and an elongated channel element connected to the other of the support structure and the attachment;

the elongated piping element comprising a head having a first width and a neck having a second width less than the first width;

the elongated channel element defining a passage configured to receive the head and an elongated gap extending away from the passage and configured to receive the neck, and the elongated gap having a third width less than the first width; and the elongated channel element comprising a flange extending away from the passage in a direction perpendicular to the elongated gap, wherein the elongated piping element comprises a plurality of head and neck sections spaced apart from one another, and wherein each of the head and neck sections is configured to protrude through a respective aperture of a webless MOLLE sheet for connection to the elongated channel element.

2. The load carrier attachment facility of claim 1, wherein the one of the support structure and the attachment to which the elongated piping element is connected comprises a flexible sheet, and wherein the neck of the elongated piping element is connected to the flexible sheet along the length of the neck.

3. The load carrier attachment facility of claim 1, wherein the one of the support structure and the attachment to which the elongated piping element is connected comprises an elongated core and a flexible sheet that wraps around the elongated core to form the head.

4. The load carrier attachment facility of claim 3, wherein the neck is stitched to closely receive the elongated core in an elongated pocket.

5. The load carrier attachment facility of claim 1, wherein the one of the support structure and the attachment to which the elongated piping element is connected comprises a flexible sheet, and wherein the head and the neck of the elongated piping element are connected to the flexible sheet along the length of the flexible sheet.

6. The load carrier attachment facility of claim 1, wherein the support structure is a garment.

7. The load carrier attachment facility of claim 1, wherein the support structure includes a flexible sheet having a periphery, and wherein at least one of the elongated piping element and the elongated channel element is connected along the periphery.

8. The load carrier attachment facility of claim 1, wherein the elongated channel element is a connector having an attachment facility configured to connect to an additional element.

9. The load carrier attachment facility of claim 8, wherein the attachment facility is defined in the flange of the elongated channel element, and wherein the additional element is a strap.

10. The load carrier attachment facility of claim 1, wherein the elongated piping element further comprises a planar backer interconnecting the head and neck sections, wherein the planar backer is configured to reside on one side of the webless MOLLE sheet, and wherein the heads protruding to connect to the elongated channel element reside on the opposed side of the webless MOLLE sheet.

11. The load carrier attachment facility of claim 1, wherein the support structure is selected from a group including vests, belts, shirts, pants, jackets, harnesses, and backpacks.

12. The load carrier attachment facility of claim 1, wherein the attachment is selected from a group including pouches, pads, holsters, shields, carriers, and securing straps.

13. The load carrier attachment facility of claim 1, wherein the other of the support structure and the attachment is connected to the flange of the elongated channel element.

14. A load carrier attachment facility comprising:

a support structure;

an attachment removably connected to the support structure;

an elongated piping element connected to one of the support structure and the attachment; and an elongated channel element connected to the other of the support structure and the attachment;

the elongated piping element comprising a plurality of head and neck sections spaced apart from one another, each of the head and neck sections comprising a head having a first width and a neck having a second width less than the first width, and each of the head and neck sections being configured to protrude through a respective aperture of a webless MOLLE sheet for connection to the elongated channel element; and the elongated channel element defining a passage configured to receive the head and an elongated gap extending away from the passage and configured to receive the neck, and the elongated gap having a third width less than the first width.

15. The load carrier attachment facility of claim 14, wherein the elongated piping element further comprises a planar backer interconnecting the head and neck sections, wherein the planar backer is configured to reside on one side of the webless MOLLE sheet, and wherein the heads protruding to connect to the elongated channel element reside on the opposed side of the webless MOLLE sheet.

16. The load carrier attachment facility of claim 14, wherein the elongated channel element is a connector having an attachment facility configured to connect to an additional element.

* * * * *